United States Patent [19]

Kirchhofer et al.

[11] Patent Number: 4,808,082

[45] Date of Patent: Feb. 28, 1989

[54] PRESSURE WAVE SUPERCHARGER

[75] Inventors: Hubert Kirchhofer, Gebenstorf; Andreas Mayer, Niederrohrdorf, both of Switzerland

[73] Assignee: BBC Brown Boveri AG, Baden, Switzerland

[21] Appl. No.: 111,579

[22] Filed: Oct. 23, 1987

[30] Foreign Application Priority Data

Oct. 29, 1986 [CH] Switzerland ..... 4280/86

[51] Int. Cl.[4] ..... F04F 11/02; F02B 33/42

[52] U.S. Cl. ..... 417/64; 123/559.2

[58] Field of Search ..... 123/559.2; 417/64; 60/39.45

[56] References Cited

U.S. PATENT DOCUMENTS

| | | | |
|---|---|---|---|
| 2,800,120 | 7/1957 | Jendrassik | 123/559.2 |
| 3,190,542 | 6/1965 | Vickery | 417/64 |
| 3,874,166 | 4/1975 | Kirchhofer et al. | 123/559.2 X |

FOREIGN PATENT DOCUMENTS

| | | | |
|---|---|---|---|
| 151407 | 8/1985 | European Pat. Off. | 123/559.2 |
| 0235609 | 2/1987 | European Pat. Off. . | |
| 638367 | 11/1936 | Fed. Rep. of Germany . | |
| 173312 | 9/1985 | Japan | 123/559.2 |
| 633619 | 12/1982 | Switzerland . | |
| 436492 | 10/1935 | United Kingdom . | |

*Primary Examiner*—Michael Koczo

*Attorney, Agent, or Firm*—Burns, Doane, Swecker & Mathis

[57] ABSTRACT

In this pressure wave supercharger, the driving belt pulley (19) for the rotor having a freewheel clutch (23) and rolling contact bearings (22) provided on both sides of the same are supported on the rotor shaft (18+20). With respect to the operation of the pressure wave supercharger, this provides the advantages of drive by the engine with constant engine/rotor transmission ratio and of a free-running rotor driven by the gas forces alone.

3 Claims, 1 Drawing Sheet

PRESSURE WAVE SUPERCHARGER

FIELD OF THE INVENTION

The present invention relates generally to pressure wave superchargers.

BACKGROUND OF THE INVENTION

The rotor of a known pressure wave supercharger of this type, such as is described for example in the Swiss Pat. No. 633,619, is driven at a constant transmission ratio by the internal combuation engine to be supercharged via a belt mentioned and belt pulley, which is connected to the rotor shaft so as to be rotationally stiff. The rotor speed is, therefore, proportional to the engine speed and, for this reason, the expression "proportional drive" is used in this connection. Since the important feature in the interaction between a supercharging device and an angine is that it should operate with the best possible efficiency in the speed range mainly used in practical operation, the geometric data of the pressure wave supercharger control elements which are critical to the supercharger efficiency, essentially the opening and closing edges of the air and gas ports and the auxiliary ducts (the gas and compression pockets, inter alia), are designed for this speed range, which corresponds approximately to 50% of the nominal rotational speed.

This pressure wave supercharger designed for a preferred, and in fact for the operationally and economically most important, engine speed range does, however, have the disadvantage that the pressure wave process does not take place in an optimum manner in the lower and higher engine speed ranges. In these ranges, in fact, the best possible exchange of energy between the exhaust gas and charge air requires a different geometric design of the air, gas and auxiliary ports, in particular their opening and closing edges.

On the other hand, undesirable pulsations in the charge air flow, an excessive exhaust gas recirculation in the charge air, a sluggish response behavior of the rotor and a loss of efficiency appear, particularly in the lower speed range. The loss of efficiency also applies to the speed range above the design speed.

In order to avoid these disadvantages, the applicant's Swiss application No. 826/86-9 describes a free-running pressure wave supercharger driven by the gas forces. In contrast to proportional drive, the rotor speed in this concept does not depend on the engine speed but on the resultant swirl energy of all the air and gas flows acting on the rotor. By various design measures on the air, gas and auxiliary ports—in association with nozzles which come into effect under certain operating conditions—it is intended that a narrower pressure wave supercharger speed range than in the case of proportional drive shall be maintained. In particular, the measures proposed there are intended to increase the drive momentum of the exhaust gases in order to speed up the rotor after the engine has been started, to control the speed characteristic of the rotor and to prevent excessive speeds.

Satisfactory operation of this concept, however, assumes the smallest possible rotor mass moment of inertia, which affects the transient behaviour of the supercharger. If the mass moment of inertia is too large, the rotor cannot in fact follow rapid changes in the speed of the vehicle engine with sufficient rapidity so that there is a certain supercharger response delay. The conventionally used material of relatively high specific gravity is responsible for the relatively large mass moment of inertia of the conventional rotors.

It will be possible to avoid this disadvantage as soon as tested materials of lighter specific weight are available; these have to be suitable for the production without difficulty of thin-walled rotors, which have to be manufactured with great precision, and must also be capable of dealing with the conditions in a pressure wave supercharger with respect to their other thermal and mechanical properties.

OBJECTS AND SUMMARY OF THE INVENTION

The present invention arises from the object of avoiding, in a pressure wave supercharger, the disadvantages described above of the pressure wave supercharger with proportional drive and of the pressure wave supercharger with free-running rotor and driven by the gas forces alone and to achieve better matching of the delivery characteristic of the supercharger to the load condition of the engine by a combination of the advantages of the two types of supercharge drive mentioned.

The pressure wave supercharger in accordance with the invention is characterized by the fact that a freewheel clutch and a rolling contact bearing on each side of the same are provided between the belt pulley and the rotor shaft.

In such a bearing arrangement of the belt pulley on the rotor shaft, the latter will be driven by the belt pulley via the locked freewheel clutch with a speed proportional to the engine speed as long as the torque exerted by the swirl energy on the rotor cells is smaller than that necessary for the current operating condition including the proportion for the transient condition. As soon, however, as the torque of the air and gas forces is sufficient, the drive connection between the freewheel clutch locking bodies and the freewheel clutch outer ring with fixed location in the belt pulley is released and the rotor runs with a higher speed until the engine, due to increased fuel supply, again speeds up and the belt pulley has overtaken the rotor so that the latter is again driven proportionally. This engagement and disengagement can, fundamentally, take place over the complete speed range. After the release of the freewheel clutch, however, the rotor speed adjusts itself to a value dependent on the drive energy of the exhaust gases but the rotor speed will never fall below the value given by the transmission ratio between the drive belt pulley of the engine and the drive pulley on the rotor shaft.

BRIEF DESCRIPTION OF THE DRAWING

The invention is described in more detail below with reference to embodiments shown in the drawing, wherein.

DETAILED DESCRIPTION OF A PREFERRED EMBODIMENT

Figure 1:
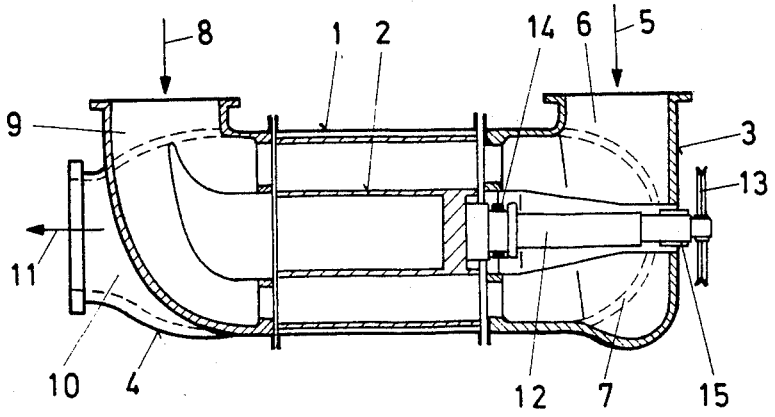
FIG. 1 is a diagrammatic view of an arrangement of a conventional pressure wave supercharger with proportional belt drive.

In the pressure wave supercharger shown in FIG. 1 in a diagrammatic longitudinal section, 1 indicates a rotor casing which encloses a rotor 2 and is terminated at its end faces by an air casing 3 and a gas casing 4. The arrow 5 indicates the entry of the induction air in a low pressure air duct 6, which induction air is compressed in the rotor 2 by the exhaust gases coming from the engine (not shown), leaves the supercharger as supercharged air through a high pressure air duct 7, extending at right angles to the duct 6, and reaches the engine. The exhaust gas coming from the engine enters a high pressure gas duct 9 of the gas casing 4 (as indicated by the arrow 8) and flows from this, after it has given up part of its energy to compress the air in the rotor 2, through a low pressure gas duct 10 as exhaust gas to the atmosphere, as indicated by the arrow 11.

The rotor 2 is connected to a rotor shaft 12 which protrudes outwards through the air casing 3, is rotationally stiffly connected, at its free end, to a belt pulley 13 and is supported in two bearings 14 and 15.

In this conventional pressure wave supercharger, therefore, the rotor 2 is driven by the engine with constant transmission ratio by a belt, preferably a V-belt, via a belt pulley 13 firmly connected to the rotor.

Figure 2:
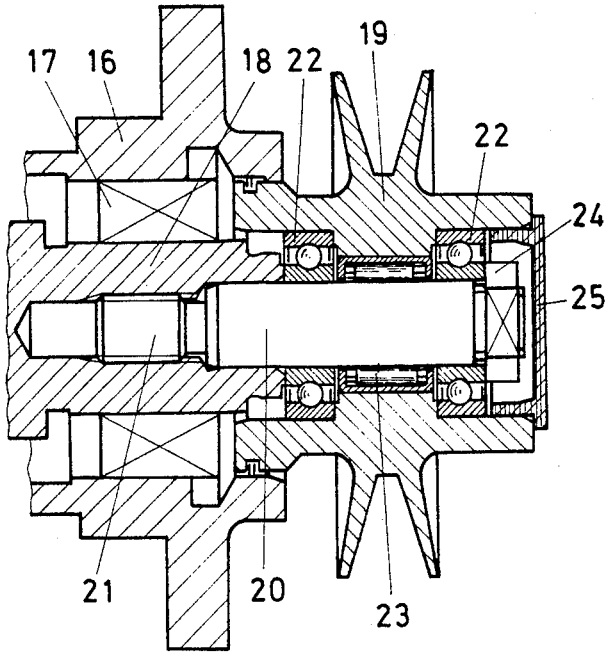
FIG. 2 is a cross-sectional view of a bearing arrangement, in accordance with the invention, of a belt pulley on the rotor shaft.

The modification of such a pressure wave supercharger in accordance with the invention is shown in FIG. 2, which shows, substantially, only the outer bearing arrangement in the air casing. A bearing flange 16, which is intended for fastening to the air casing (not shown) accepts a diagrammatically shown rolling contact bearing 17 on the free end of the rotor shaft 18. The belt pulley 19 is suppored on a shaft spigot 20, concentric with the rotor shaft 18 and screwed into the shaft 18 by means of a threaded spigot 21, on two grooved ball-bearings 22 and a freewheel clutch 23 located between the latter. A nut 24 on the free end of the shaft spigot 20 clamps the two bearings 22 and the freewheel clutch 23 located between them against the end surface of the rotor shaft 18. A protective cap 25 pressed in at the free end of the belt pulley 19 prevents the penetration of dirt into the belt pulley bearing arrangement.

Figure 3:
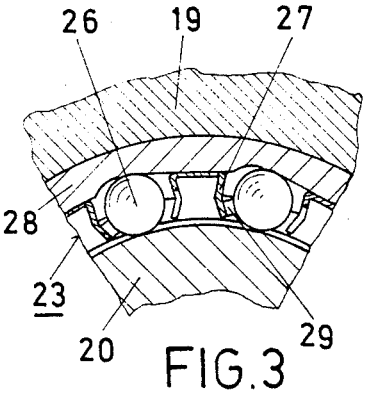
FIG. 3 is a partial cross-sectional view of a detail of the freewheeling clutch.

FIG. 3 shows an increased-scale excerpt from the freewheel clutch 23 of FIG. 2. This freewheel clutch of known type has rollers 26 as the locking bodies; these rollers are held by a cage 27 in such a way that they can move with the clearance necessary for the locking effect and for the declutching effect in the peripheral direction relative to the outer ring 28. The rollers 26 are pressed into the locking position by leaf springs 29, which consist of short flaps bent out of the cage, the prestress force being adjusted in such a way that it is possible for the belt pulley forcibly driven by the engine to be overtaken up to the range of the nominal speed. The type shown in FIG. 3 has no inner ring and the rollers therefore run directly on the hardened shaft spigot 20.

Figure 4:
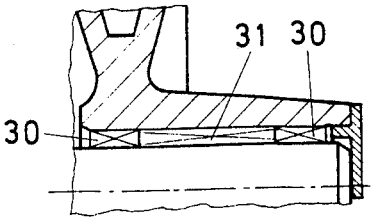
FIG. 4 is a partial cross-sectional view of an excerpt from a simplified bearing arrangement of the belt pulley on the rotor shaft in accordance with the invention.

Other types of freewheel clutches, with or without inner ring, can, of course, also be used for the present purpose. The type shown in FIG. 3 is, however, particularly economical in space and is to be preferred because of the desirability of the most compact possible dimensions for pressure wave superchargers for motor vehicle engines. Even more favorable in this respect is the design shown in FIG. 4 in which a freewheel clutch 23 of the type described above is combined with two needle bearings 30, again without inner ring and of the same external diameter as the freewheel clutch 31, instead of the annular ball-bearings of FIG. 3.

This concept with proportional drive of the belt pulley and a freewheel clutch between the latter and the rotor shaft makes it possible to design the control edges of the ports for higher rotor speeds as compared with pure proportional drive. This gives improved efficiency, less idling recirculation and pulsation sensitivity and improved response behaviour in the whole of lower and medium engine speed range. An installation advantage is that smaller exhaust gas receivers can be employed. The upper rotor speed range can be matched to a lower level, which again improves the efficiency.

What is claimed is:

1. A pressure wave supercharger comprising:
   - a rotor casing having two ends;
   - an air casing mounted at one end of the rotor casing and a gas casing mounted at the other end of the rotor casing, the air and gas casings each including ducts for supplying and removing air and gas to the rotor casing;
   - a rotor enclosed in the rotor casing and including cells around the periphery thereof;
   - a rotor shaft supporting the rotor in the rotor casing and extending through the air casing, first bearings being provided between the rotor shaft and the air casing for mounting the rotor shaft in the air casing; and
   - a belt pulley mounted on the rotor shaft, a freewheel clutch and second bearings on each side thereof being provided between the belt pulley and the rotor shaft, the belt pulley being adapted to be driven via a belt, by an internal combustion engine which is to be supercharged by the pressure wave supercharger.

2. The pressure wave supercharger as defined in claim 1, wherein the freewheel clutch is a sleeve freewheel including locking bodies formed by rollers, the second bearings being grooved ball bearings located one on each side of the freewheel clutch.

3. The pressure wave supercharger as defined by claim 1, wherein the freewheel clutch is a sleeve freewheel including locking bodies formed by rollers, the second bearings being needle bearings located one on each side of the freewheel clutch.

* * * * *